US006814009B2

(12) United States Patent
Acevedo et al.

(10) Patent No.: US 6,814,009 B2
(45) Date of Patent: Nov. 9, 2004

(54) LOAD BEARING PILLAR

(75) Inventors: Mario Acevedo, Phoenix, AZ (US); Hirokazu Goto, Trnava (SK); Brian Kim, San Diego, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 204 days.

(21) Appl. No.: 09/974,439

(22) Filed: Oct. 9, 2001

(65) Prior Publication Data

US 2003/0066463 A1 Apr. 10, 2003

(Under 37 CFR 1.47)

Related U.S. Application Data

(60) Provisional application No. 60/280,056, filed on Mar. 30, 2001.

(51) Int. Cl.[7] ..... A47B 37/00

(52) U.S. Cl. ..... 108/50.02; 108/93; 108/157.16; 312/7.2; 312/223.6; 312/351.2

(58) Field of Search ..... 108/93, 101, 184, 108/186, 50.02, 158, 157.16, 56.1, 159.11; 248/678, 676, 165, 346.01, 188.1, 188, 158, 163.1; 312/7.2, 223.3, 223.1; 348/836, 843; 52/731.4, 732, 732.3

(56) References Cited

U.S. PATENT DOCUMENTS 3,917,368 A * 11/1975 Gusdorf et al. ..... 52/732.3
4,128,253 A * 12/1978 Powers ..... 108/56.1
4,738,058 A * 4/1988 Svensson ..... 52/732.3
5,125,725 A * 6/1992 Blunt ..... 312/7.2
5,160,104 A * 11/1992 Sher ..... 248/176.1
5,216,211 A * 6/1993 Renk, Jr. ..... 312/7.2
5,351,629 A * 10/1994 Breezer et al. ..... 108/56.3
5,584,595 A * 12/1996 Gantitano et al. ..... 403/24
5,606,920 A * 3/1997 Meyer et al. ..... 108/50.02
5,901,513 A * 5/1999 Mollenkopf et al. ..... 108/50.02
5,961,192 A * 10/1999 Bernart et al. ..... 312/223.3
6,095,623 A * 8/2000 Goto et al. ..... 312/7.2
6,484,647 B2 * 11/2002 Lininger, Jr. et al. .... 108/50.01
6,661,473 B1 * 12/2003 Teshima et al. ..... 312/7.2

FOREIGN PATENT DOCUMENTS

JP 2645728 * 10/1990
JP 05328264 * 12/1993
JP 06245168 * 9/1994

* cited by examiner

*Primary Examiner*—Lanna Mai
*Assistant Examiner*—Hanh V. Tran
(74) *Attorney, Agent, or Firm*—Steven L. Nichols; Rader, Fishman, & Grauer PLLC

(57) ABSTRACT

A novel pillar is provided. The pillar having a longitudinal axis and first and second ends, an outer skin, an extruded support structure disposed within the outer skin, with the support structure including multiple cells arranged along the longitudinal axis for support of longitudinal loads, and a tension bar disposed at least partially within the extruded support structure. The outer skin and extruded support may include structural plastic, and the extruded support structure may be separately insertable into the outer skin. However, in an alternative embodiment the outer skin and extruded support structure are co-extruded as a single monolithic piece.

7 Claims, 11 Drawing Sheets

LOAD BEARING PILLAR

RELATED APPLICATIONS

The present application claims priority under 35 U.S.C. §119(e) from prior-filed provisional patent application 60/280,056, entitled "Appliance Stand" filed Mar. 30, 2001, which is incorporated herein by reference in its entirety. The present also claims priority under 35 U.S.C. §120 from prior-filed design patent application 29/139,503, entitled "Appliance Stand" filed Mar. 30, 2001, which is incorporated here in by reference in its entirety.

FIELD OF THE INVENTION

The present invention relates to equipment support apparatus, and more particularly to a load bearing pillar.

BACKGROUND OF THE INVENTION

Over the last few years, television sets, the source devices which provide a signal to the television set, and other appliances have become increasingly more complicated. Some of these television sets and appliances are extremely heavy. Traditionally, a television set was placed on top of a cabinet or television stand. These cabinets or stands are typically made of particle board or plastic and are often unable to support the loads of the modem television sets and other appliances without sagging and sometimes even failing altogether. While a solid wood stand may be available to add strength, the weight and expense of solid wood furniture can be prohibitive. Thus, a pillar for supporting an appliance stand that is light weight, rigid, and strong is needed.

Further, the typical television stand may include a front door that opens to allow insertion of source devices such as digital video disk players (DVD players), laser disc players, and video cassette recorders (VCRs). In order to reach wiring used to interconnect components such as source devices and the television unit, components were often removed from the television stand by opening the doors and pulling the components out of the front of the television stand. Once removed, connectors such as RCA connectors are connected before returning the components to the cabinet. Such removal and installation of components is inconvenient. Removal and insertion of a component also required cables that are longer than necessary. Longer cables are needed to allow for movement of the components in and out of the front of the cabinet. Extra cable length contributes to cost and also results in deterioration of the signal due to parasitic capacitance and resistances inherent in a longer cable. Longer cables are also susceptible to electromagnetic interference. Thus, an improved method for connecting components which provide a signal to a television unit is needed.

A second disadvantage of traditional display stands is that traditional display stands required four support structures. Typically, the four-support structures or four-support pillars were used to support the four corners of an approximately rectangular surface used to support a television set. One disadvantage of using four load bearing structures is that using four support pillars increases the cost and the materials needed to fabricate the cabinet. A second disadvantage of using four support structures is that a four-support structure configuration typically utilizes an approximately rectangular top surface which does not match the almost triangular top shape of a traditional cathode ray tube (CRT) television unit. A television unit typically has a CRT which increases in size as one moves towards the screen area.

Thus, an improved support pillar and appliance stand are needed.

SUMMARY OF THE INVENTION

There is disclosed in one embodiment a pillar having a longitudinal axis and first and second ends, the pillar including an outer skin, an extruded support structure disposed within the outer skin, with the support structure including multiple cells arranged along the longitudinal axis for support of longitudinal loads, and a tension bar disposed at least partially within the extruded support structure. In this embodiment the outer skin and extruded support may include structural plastic, and the extruded support structure may be separately insertable into the outer skin. However, in an alternative embodiment the outer skin and extruded support structure are co-extruded as a single monolithic piece.

In one embodiment, the extruded support structure further includes a cavity for housing the tension bar. According to this embodiment there may also be at least one protrusion extending from each of the first and second ends of the pillar. The at least one protrusion extending from the first end of the pillar may be adapted to engage a recess in an appliance stand base and the at least one protrusion extending from the second end of the pillar may be adapted to engage a recess in an appliance stand top member. Further, there may be at least one threaded recess disposed in each of the first and second ends of the pillar. A first fastener may extend through the appliance stand base and into the threaded recess in the first end of the pillar to attach the first end of the pillar to the appliance stand base, and a second fastener may extend through the appliance stand top member and into the threaded recess in the second end of the pillar to attach the second end of the pillar to the appliance stand top member.

In one embodiment the outer skin comprises three generally flat sides and a one generally curved side.

In one embodiment the tension bar engages at least one rotating cam, wherein rotation of the cam imparts tension to the tension bar. The tension bar may impart tension to the extruded support structure.

There is also disclosed an appliance stand including a base, a top member spaced from the base and connected thereto by at least one pillar having a longitudinal axis, the at least one pillar including: an outer skin, an extruded support structure disposed within the outer skin, the support structure including multiple cells arranged along the longitudinal axis for support of longitudinal loads, and a tension bar disposed at least partially within the extruded support structure.

There is disclosed a method of providing support to an apparatus including the steps of: providing a pillar outer skin, extruding a multi-cell support structure in a monolithic configuration, inserting the multi-cell support structure into the pillar outer skin, inserting a tension bar into the multi-cell support structure, and imparting a tension force to the tension bar. The step of imparting a tension force to the tension bar may include rotating a cam engaged with the tension bar.

In one embodiment there is disclosed an appliance stand including: a base, a top member spaced from the base, and a first support pillar connected between the base and the top member, the first support pillar defining a channel for housing wires. The channel may be enclosed by a removable access panel. In this embodiment the appliance stand may further include a second support pillar connected between the base and the top member, with the second support pillar defining a plurality of cells arranged in a monolithic structure. The second support may further include a tension bar with first and second ends, and the tension bar may be put in tension by engagement with a rotating cam. The tension bar may also impart tension to the second support pillar. In this embodiment there may be a plurality of protrusions extending from first and second ends of the second support pillar, the plurality of protrusions being adapted to engage a corresponding number of recesses in the base and top members. This embodiment may also include a side cap adapted to lockingly engage the top member and house the engagement between the plurality of protrusions extending from the first end of the second support pillar and the recesses in the top member. This embodiment may include a third support pillar connected between the base and the top member, the third support pillar defining a plurality of cells arranged in a monolithic structure.

In one embodiment the base is arranged in a generally V-shaped or boomerang-shaped configuration. In such an embodiment, the first support pillar may be attached at an apex of the base, a second support pillar may be attached at a first end of the base, and a third support pillar attached at a second end of the base.

In some embodiments of the disclosed appliance stand, there may be a shelf attached between the base and the top member. The shelf may be adjustable between at least two positions. The shelf may be a glass shelf and may be supported between the top member and the base by a bracket mounted to the first support pillar and by a shelf support assembly. The shelf support assembly may include a glass support member and at least one support member rod.

In one embodiment of the disclosed appliance stand and pillars, the first support pillar comprises at least one hole extending laterally therethrough. A television may be disposed on the top member in this embodiment. At least one wire may extending from the television, into the channel, and through the at least one hole extending through the first support pillar, and the top member may thus include a wire access hole leading to the channel.

There is disclosed a television support, the television support including a television shelf, a plurality of legs attached to and supporting the television shelf, at least one of the plurality of legs comprising a multi-cell extruded pillar, and a channel extending along at least a portion of at least one of the plurality of legs, the channel defining a wire-path. The channel may be enclosed by a removable panel. The plurality of legs are attached to a base. The television support may include a glass shelf arranged below the television shelf for supporting an audio-visual component. There may be a television supported on the television shelf, and a wire extending from the television, into the channel, through a least one of the plurality of legs, and to the audio visual component. The television may be attached to the television support via a television clip.

There is also disclosed a method of making an appliance support including the steps of: extruding a plurality of multi-cell pillars, attaching the plurality of multi-cell pillars between a base and a shelf, and attaching an additional pillar between the base and the shelf, the additional pillar defining a channel for housing a wire. The method may further include the step of inserting a tension bar into each of the plurality of multi-cell pillars and applying tension to the tension bar. The method may also include attaching an adjustable component shelf to the shelf, the adjustable component shelf being arranged between the shelf and the base.

There is disclosed an apparatus including: a base, a shelf, at least three supports connecting the base to the shelf, where a first of the at least three supports includes a channel therein, and second and third of the at least three supports are arranged coplanar with one another and approximately equidistant from the first channel to define an acute angle with the first support, where the second and third supports include multi-cell monolithic structures with the cells arranged longitudinally within each of the second and third supports.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Figure 1:
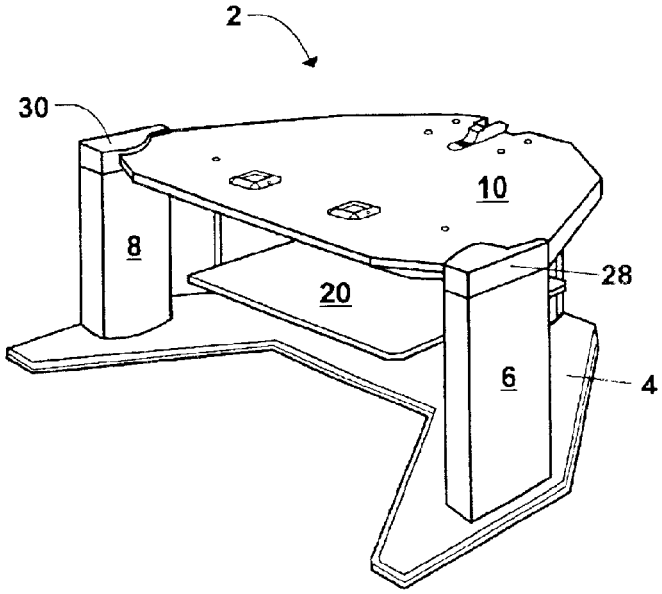
FIG. 1 is a perspective view of a pillar in a completed appliance stand.
Figure 2:
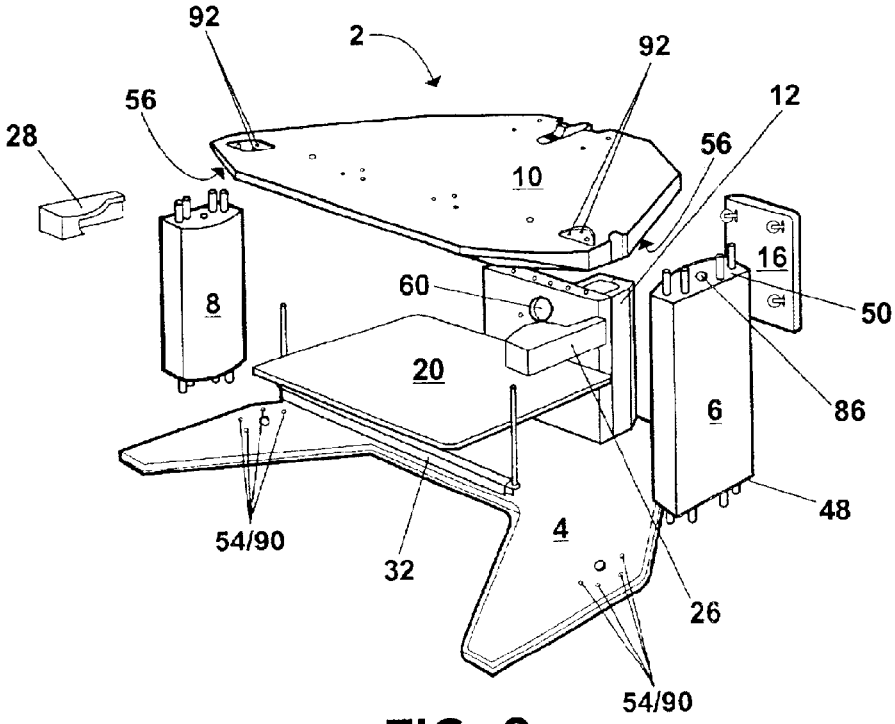
FIG. 2 is an assembly view of the completed stand shown in FIG. 1.

Turning now to the drawings, and in particular to FIGS. 1–2, one implementation of an embodiment of the invention is disclosed. In the embodiment of FIG. 1, one embodiment of an appliance support or stand—in FIGS. 1–2 a television stand 2—is shown. Television stand 2 may include a base 4, a top member 10 spaced from base 4, and a plurality of supports or pillars, for example legs 6, 8, and 12. First leg 12 is more clearly shown in FIGS. 3–4. First leg 12 may be made of wood or other suitable material and in the embodiment shown includes a plurality of recesses 62 to facilitate attachment to base 4 and top member 10. Recesses 62 are receptive of mating protrusions, for example spreading bolts 64 and dowels 66. Other fasteners may also be used by the skilled artisan having the benefit of this disclosure. First leg 12 includes a channel, for example wire channel 14 shown in FIGS. 3–4. In the embodiment shown, wire channel 14 is enclosed on only three sides, but wire channel 14 may also be entirely enclosed permanently or temporarily. As shown in FIG. 5, wire channel 14 is enclosable in the illustrated embodiment by a removable access panel, in the exemplary embodiment by wire access panel 16. The combination of wire channel 14 and wire access panel 16 may enclose wires 68 shown in FIG. 5, which may be cables such as RCA cables communicating between a television set and an audio-visual component such as a receiver, DVD player, VCR, Laser Disc player, or other component. Wire channel 14 may also house power cords and/or other wires. Wire access panel 16 may include removable fasteners, such as mini-balls 70 shown in FIG. 5 to facilitate attachment to, and detachment from, first leg 12. Wire access panel 16 and channel 14 advantageously provide a path for wires to travel while hiding them from view and maintaining easy accessibility. In an alternative embodiment (not shown), the access panel 16 is permanently attached and channel 14 is always fully enclosed.

Figure 3:
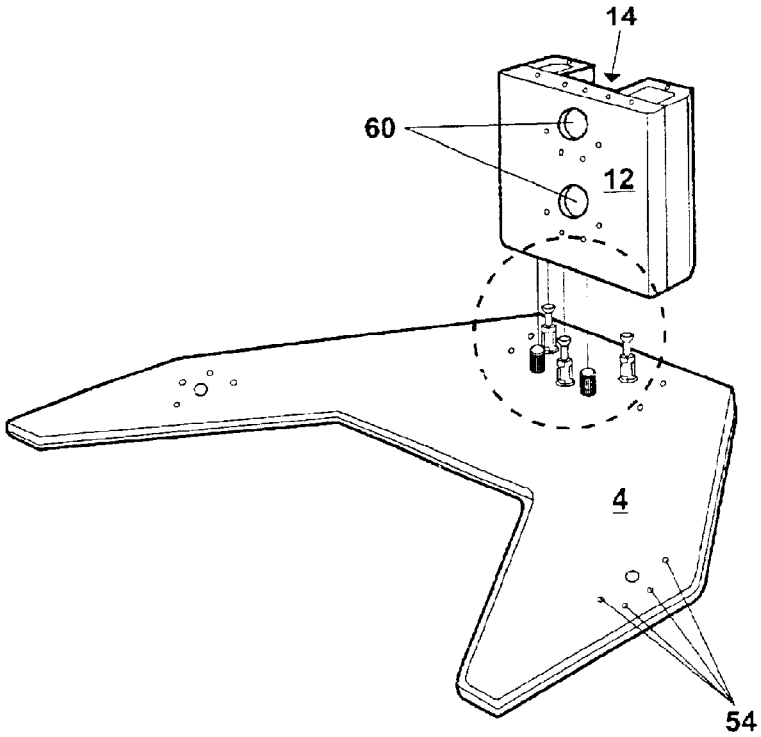
FIG. 3 is a perspective assembly view of a base and pillar according to the present invention.
Figure 4:
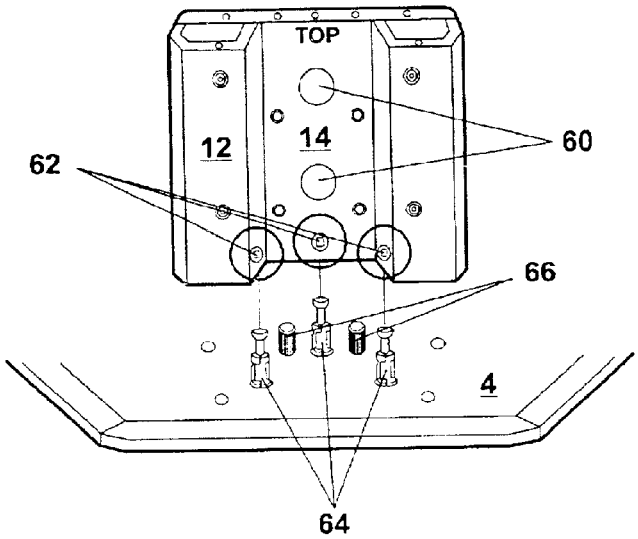
FIG. 4 is a back view of the base and pillar shown in FIG. 3.
Figure 6:
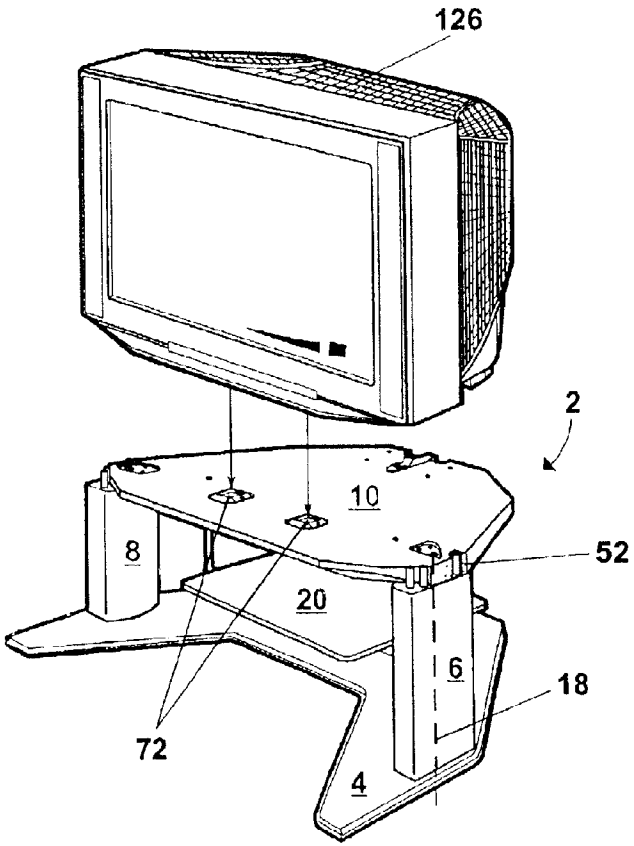
FIG. 6 is a front perspective view of an appliance stand in relation to a television set according to the present invention.
Figure 5:
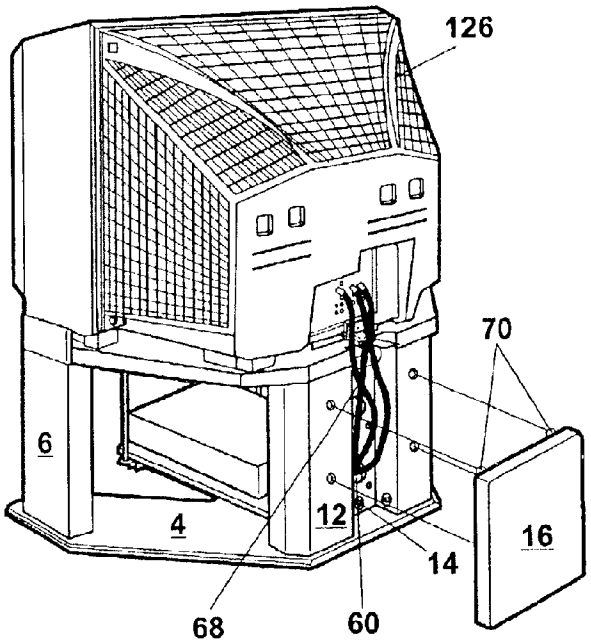
FIG. 5 is a back perspective view of an appliance stand in relation to a television set according to the present invention.

As shown in FIGS. 3, 4, and 5, first leg 12 may also include one or more lateral holes, for example wire access passages 60. Wire access passages 60 extend through first leg 12 and facilitate the easy connection of any audio-visual components to a television set or other receiver.

Figures 7A, 7B, 7C:
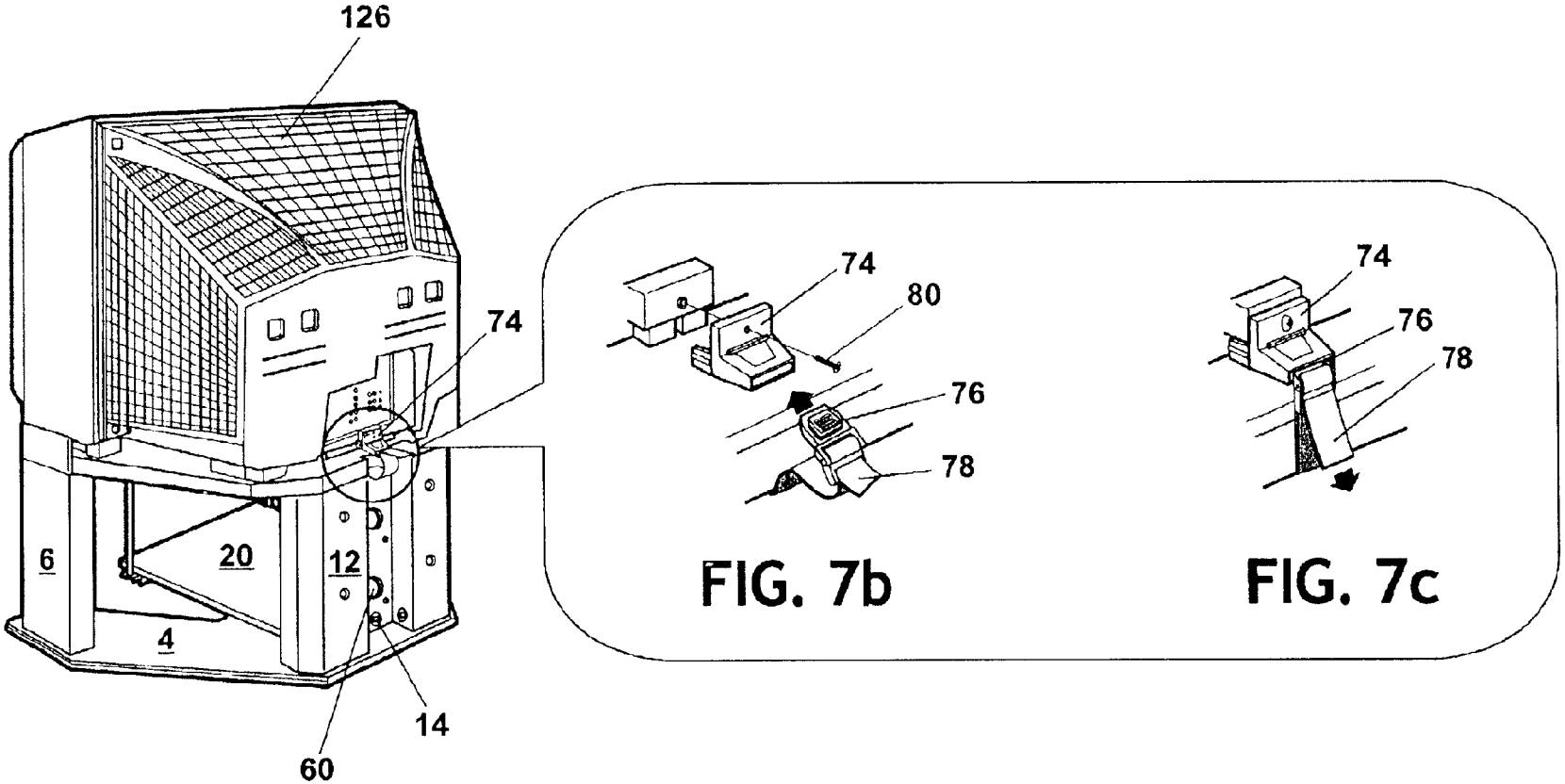
FIG. 7*a* is a back perspective view of an appliance stand, television set, and television clip holder.
FIG. 7*b* is an assembly view of the television clip holder shown in FIG. 7*a*.
FIG. 7*c* is an assembled view of the television clip holder shown in FIG. 7*b*.
Figures 8A, 8B:
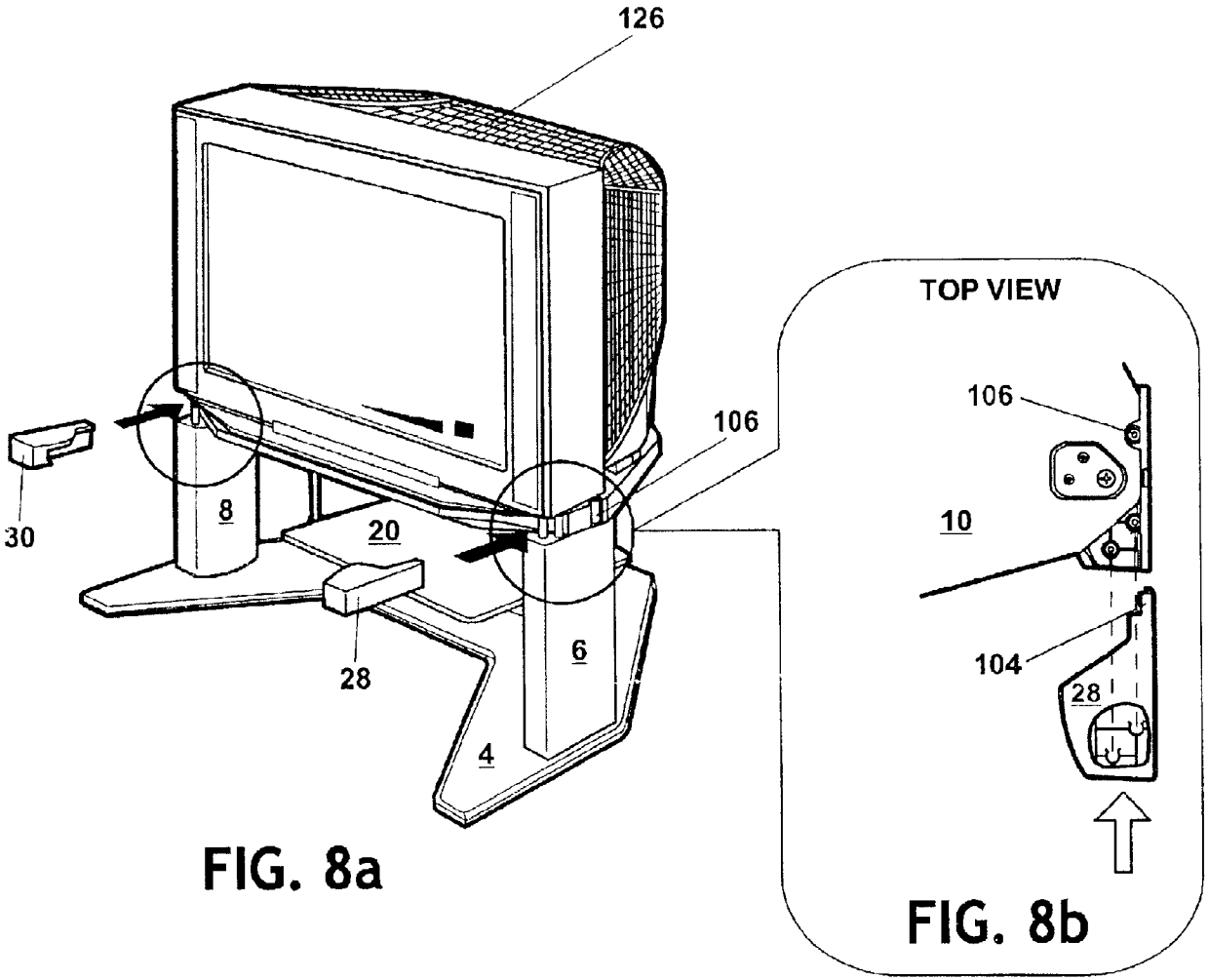
FIG. 8*a* is a front perspective view of an appliance stand and television set with side caps.
FIG. 8*b* is a top view of the appliance stand and side caps shown in FIG. 8*a*.
Figure 9:
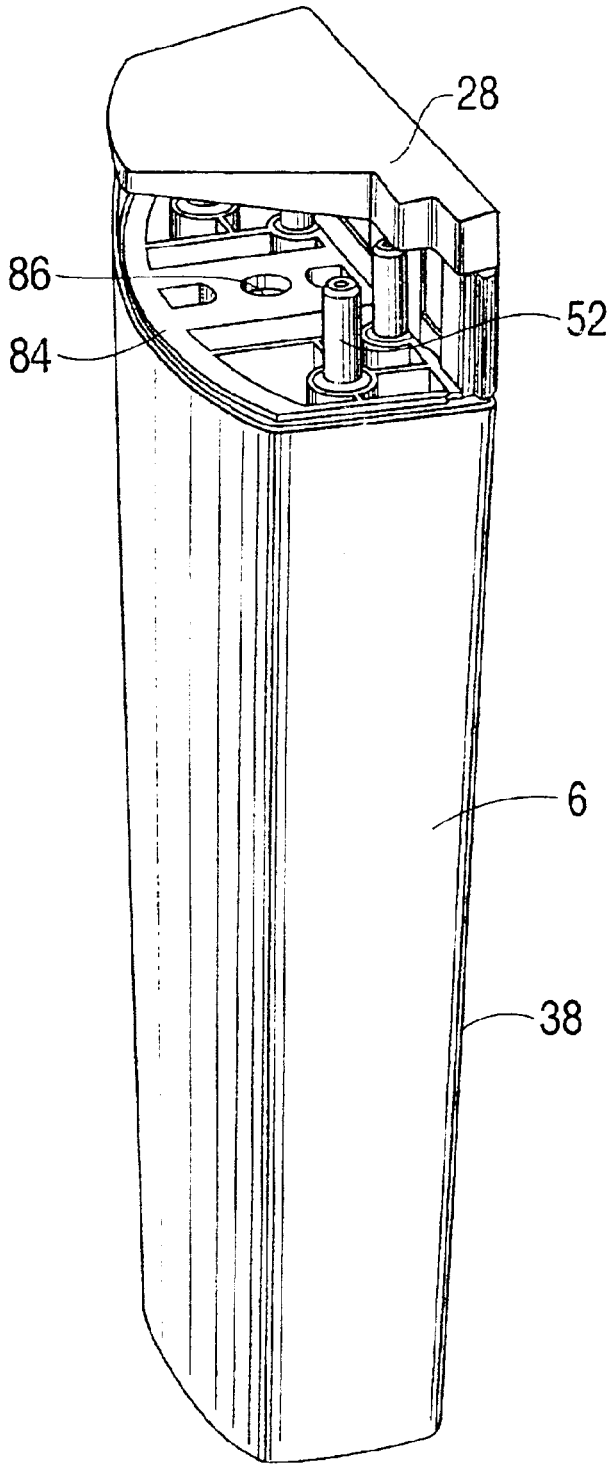
FIG. 9 is a perspective view of a pillar according to the present invention.
Figure 10:
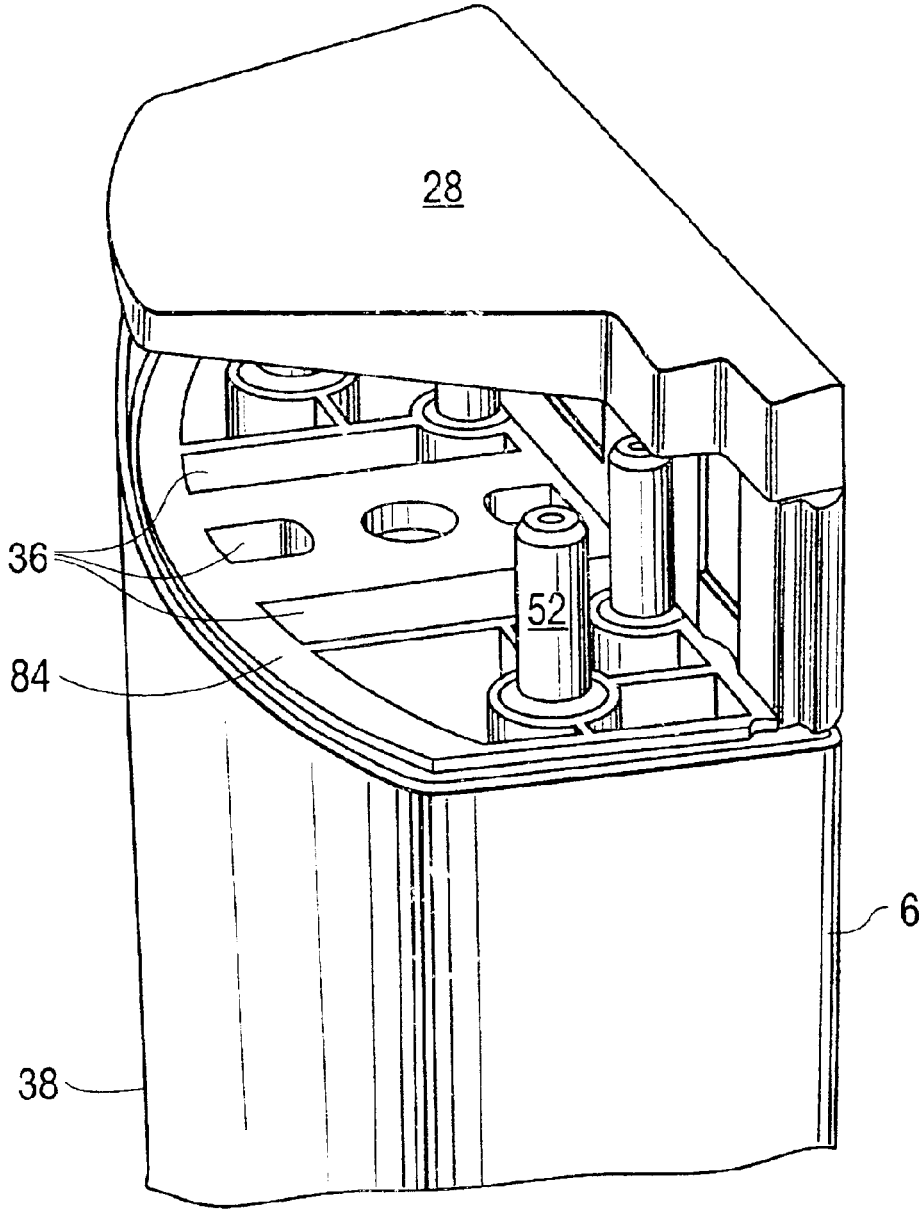
FIG. 10 is a detailed perspective view of one end of the pillar shown in FIG. 1.

Base 4 is shown in the Figures with a general V-shape or boomerang shape to facilitate stability with fewer than four legs. In addition, top member 10 may be tapered as shown to provide a surface approximately the same shape as the footprint of a television set. Generally television sets are tapered from the screen to the rear of the set, and the top member 10 is designed to match this generally triangular shape. Top member 10 may be equipped with one or more pads and a locking holder, for example foot guides 72 and a clip holder 74. Clip holder 74 may be more clearly seen in FIGS. 7*a*–7*c*. Foot guides 72 may be adjusted to correspond to any arrangement of legs or feet on a television or other appliance, and clip holder 74 may be receptive a clip 76 that is attached to a strap 78 for securing a television or other appliance to top member 10. Clip holder 74 may be attached to a television or other appliance by a fastener, for example screw 80.

Referring again to FIGS. 1–2, television stand 2 may also include second and third legs 6 and 8, respectively. Second and third legs 6 and 8 are substantially identical and provide support to top member 10. However, it will be understood by one of skill in the art with the benefit of this disclosure that legs 6 and 8 are not limited to use for television stand 2. Legs 6 and 8 may be used in any application in which support of a top member is necessary. Legs 6 and 8 advantageously provide a strong, light-weight, and inexpensive alternative to prior support legs.

Referring to FIGS. 9, 10, and 11*a*–11*c*, one embodiment of leg 6 exhibits a longitudinal axis 82 and first and second ends 48 and 50. In the embodiment shown, leg 6 includes an outer skin 38. Outer skin 38 may be made of extruded plastic, for example PVC, but this is not necessarily so. Outer skin 38 may be made of any suitable material. As shown in FIGS. 9, 10, and 12*a*–12*b*, leg 6 also includes a support structure, for example extruded support structure 84. Extruded support structure 84 is a single extruded piece of rigid structural plastic. In the present embodiment, the rigid structural plastic is poly-vinyl-chloride (PVC). Extruded support structure 84 is a multi-celled configuration with cells 36 arranged longitudinally along axis 82. In the embodiment shown in FIGS. 12*a*–12*b*, extruded support structure 84 includes twelve cells, however other multi-cell configurations are contemplated by the present invention, including cell configurations of from two to twenty cells, from four to sixteen cells, from eight to twelve cells, and greater than twenty cells. The multi-cell extruded support structure 84 may be extruded as a single monolithic unit as shown. It will be appreciated by one of skill in the art with the benefit of this disclosure that the multi-cell configuration advantageously provides added strength and rigidity while minimizing weight and mass. Extruded support structure 84 may be manufactured separately from skin 38, but this is not necessarily so. In the embodiment shown, extruded support structure 84 is separately insertable into skin 38, but in an alternative embodiment extruded support structure 84 and skin 38 are extruded together as a single piece. Extruded support structure 84 is shaped to fit snugly within skin 38. The longitudinal, monolithic, multi-celled arrangement provides for high strength and rigidity, enabling the support of longitudinal loads transmitted to the leg.

Leg 6 also may also include a cavity 86 for housing a tension bar 18. Tension bar 18 may be a metallic beam, for example a metal alloy such as stainless steel. Tension bar 18 extends at least partially through leg 6. In the embodiment shown, tension bar 18 extends all the way through leg 6. Tension bar 6 is advantageously used to impart a positive load to leg 6 to further increase the strength and rigidity of the leg. Tension bar 6 is engagable with one or more tensioners, for example cam casting 46. Cam casing 46 is rotatable to put tension bar 6 in tension. The tension imparted to tension bar 6 is then communicated to extruded support structure 84. A tension force of approximately five to one hundred pounds may be applied to the tension bar.

Figure 11C:
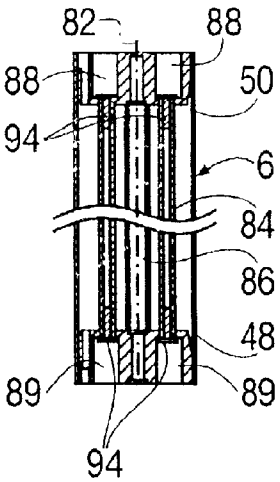
FIG. 11*c* is a side cross sectional view of the pillar shown in FIG. 11*a*.
Figure 11B:
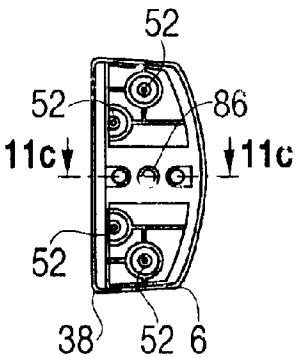
FIG. 11*b* is a top view of the pillar shown in FIG. 11*a*.
Figure 11A:
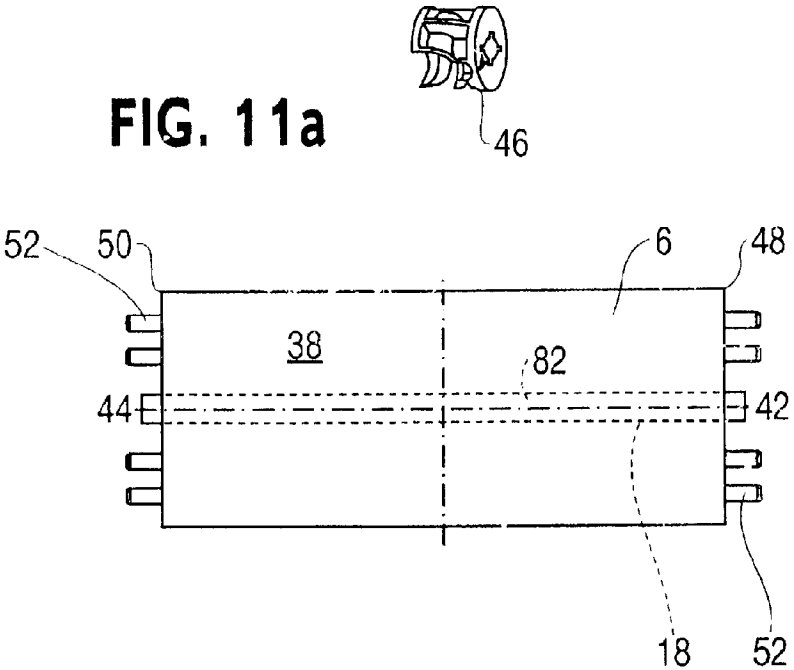
FIG. 11*a* is a side view of a pillar according to the present invention.

Referring to FIGS. 11*a*–11*c*, leg 6 may include a plurality of protrusions 52 extending from both first and second ends 48 and 50 of leg 6. In the embodiment shown, four protrusions extend from each end, but the number of protrusions is not so limited. Leg 6 may include three or few protrusions, or five or more protrusions. Protrusions 52 may be circular in cross section as shown, but this is not necessarily so. Protrusions 52 may be integral and extruded monolithically with extruded support structure 84, or they may be separately formed and added as an insert into skin 38 as shown in the present embodiment. Protrusions 52 are provided for engagement with corresponding recesses 54 and 56 found in base 4 and top member 10 of stand 2. Protrusions 52 facilitate engagement and attachment of leg 6 to base 4 and top member 10. Protrusions 52 also facilitate the alignment of one or more recesses 88 and 89 in first and second ends 48 and 50 with corresponding holes 90 and 92 in base 4 and top member 10. Recesses 88 and 89 may be threaded and are receptive of a fastener, for example screws 94, which connect leg 6 between base 4 and top member 10. Third leg 8 is substantially identical to leg 6 in structure and connection as shown in the figures.

The engagement of protrusions 52 with recesses 89 in second end 48 may be housed by a side cap 28 (likewise a second side cap 30 may be employed opposite side cap 28). Side caps 28 and 30 are shown in FIGS. 1–2 and 8*a*–8*b*. Side caps 28 and 30 include a finger 104 adapted to engage a divot 106 in top member 10 in a snap-fitting relationship. Side caps 28 and 30 thereby hide the holes and screws from view and offer an aesthetically pleasing look to the top member while protecting the fasteners and recesses from wear and inadvertent manipulation.

Figures 12A, 12B:
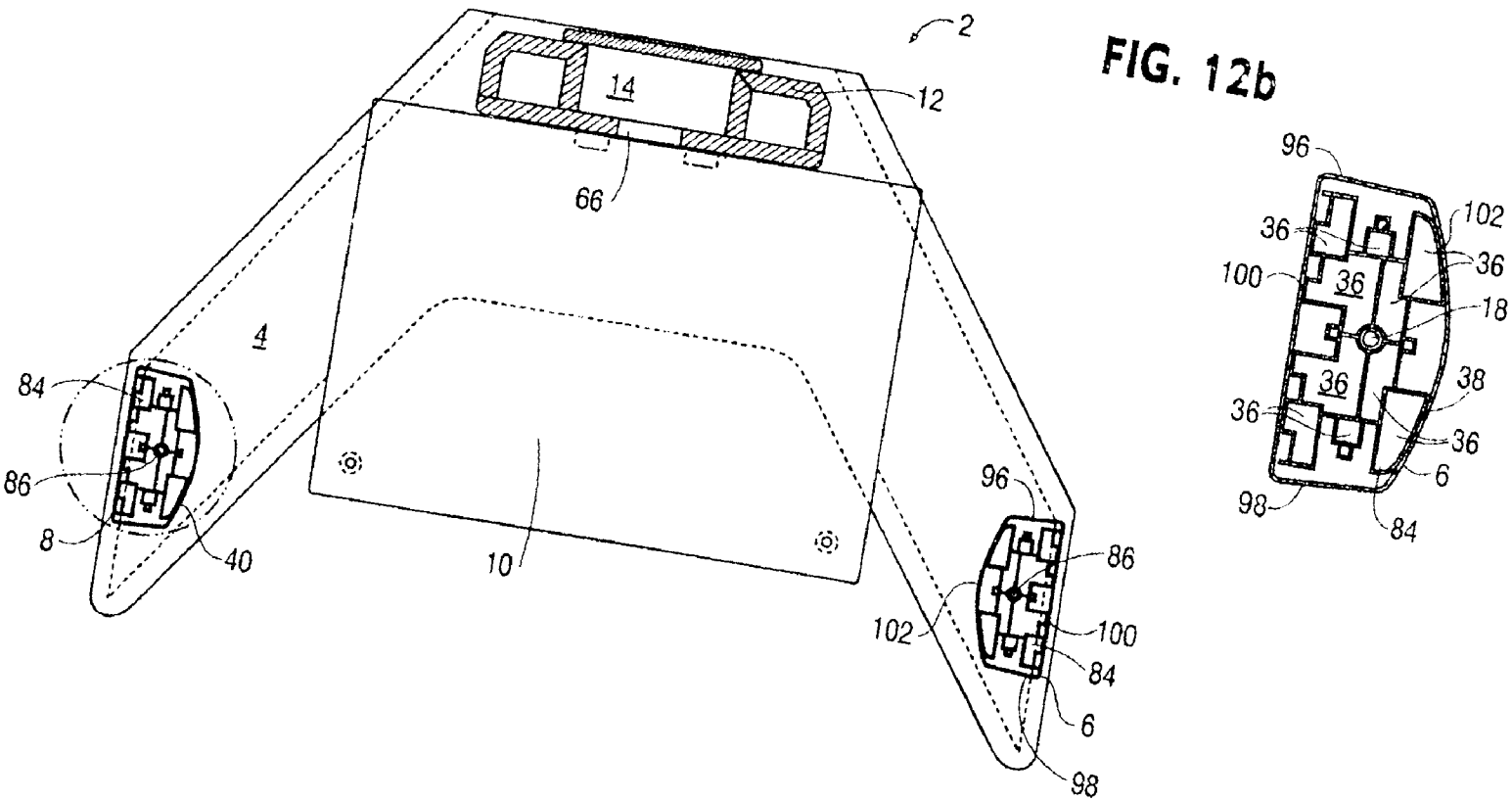
FIG. 12*a* is a top cross sectional view of a pillar in relation to an appliance stand according to the present invention.
FIG. 12*b* is a detail of the pillar cross section shown in FIG. 12*a*.
Figure 13B:
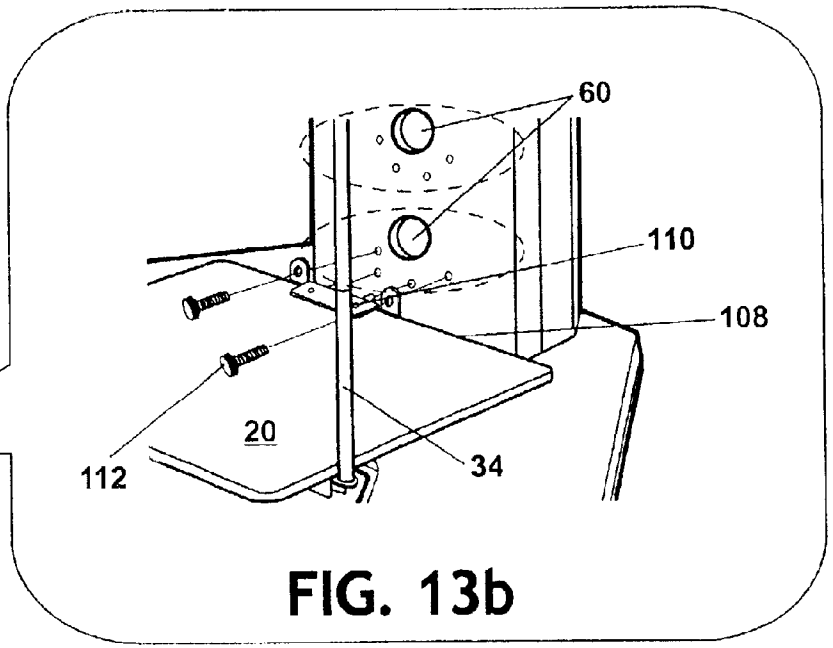
FIG. 13*b* is a detail of the floating shelf assembly shown in FIG. 13*a*.
Figure 13A:
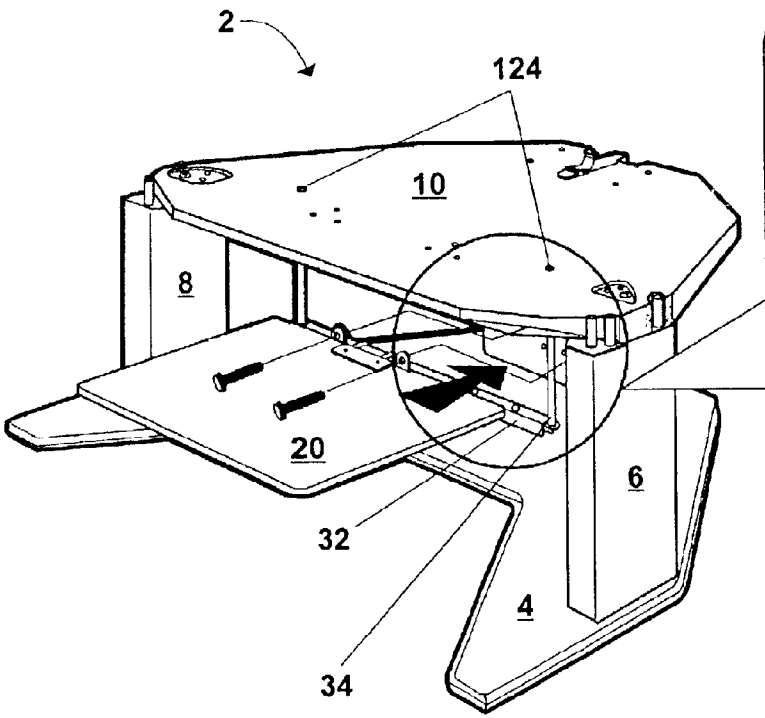
FIG. 13*a* is a perspective assembly view of an appliance stand and floating shelf according to the present invention.

Outer skin 38 and 40 of legs 6 and 8 may exhibit the polygonal shape shown in FIG. 12*b*. Outer skins 38 and 40 include three generally flat sides and one generally curved side, although each of the comers is also rounded in the present embodiment. In the present embodiment, first and second opposing sides 96 and 98 are approximately equal in length, indicating that each is within ±20% of the length of the other. A third side 100 is longer than the first and second sides, and a fourth side 102 is generally curved. As shown in the Figures, first and second sides 96 and 98 each form an acute angle with third side 100. It will be understood by those of skill in the art with the benefit of this disclosure that the polygonal configuration described is exemplary in nature.

Figure 14B:
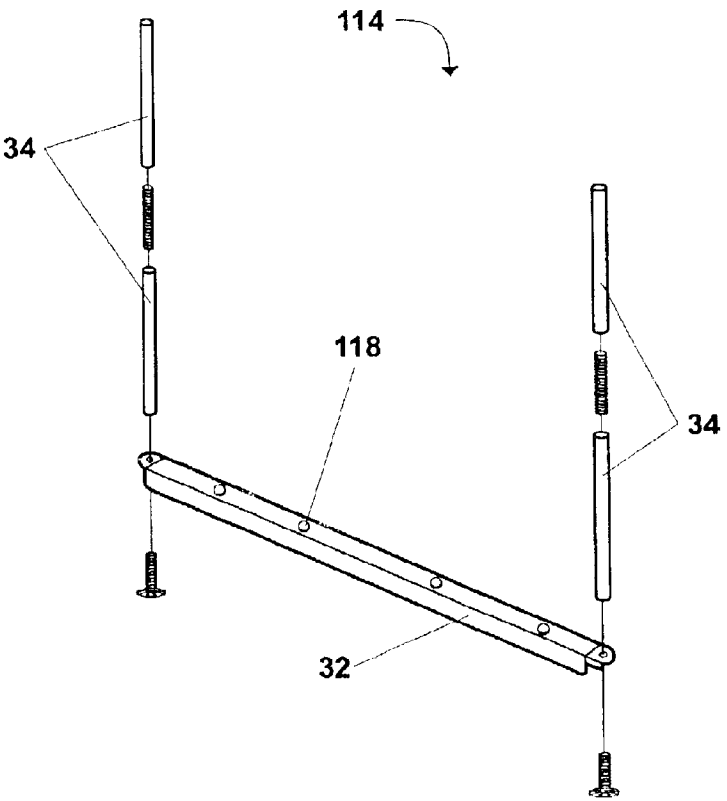
FIG. 14*b* is a perspective view of an alternative embodiment for a floating shelf support assembly according to the present invention.
Figure 14A:
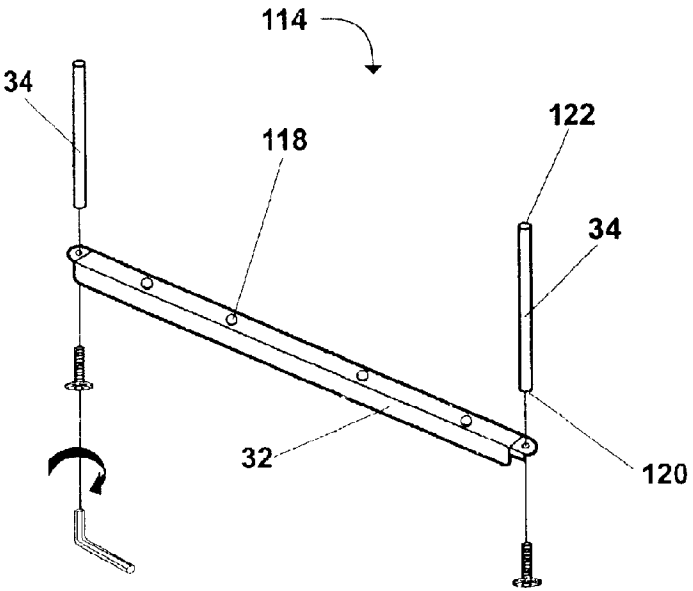
FIG. 14*a* is a perspective view of a floating shelf support assembly according to the present invention.

Referring next to FIGS. 13*a*–14*b*, in one embodiment of the present invention there is a shelf, for example a floating component shelf 20, disposed between top member 10 and base 4. Floating component shelf 20 may be generally parallel to the base and top member. Floating component shelf 20 may be made of glass or other suitable material. Floating component shelf 20 is adapted to support audio-visual components or other items, including, but not limited to, VCR's, receivers, DVD players, Laser Disc players, cable boxes, HDTV converters, satellite receivers, and the like. Floating component shelf 20 may be attached along a first edge 108 to first leg 12 via a mounting bracket 110 and one or more fasteners 112. Floating component shelf 20 may be further mounted to stand 2 by a support assembly 114. Support assembly 114 may include a shelf support 32 and at least one shelf support rod, for example support rods 34. Each support rod 34 is internally threaded in the embodiment shown to receive fasteners such as screws 116. Shelf support 32 is disposed below floating component shelf 20 and includes a plurality of rubber bumpons 118 to minimize slip of the glass component shelf. Each end of shelf support 32 includes a hole through which screws 116 may extend to connect first ends 120 of support rods 34 to shelf support 32. Second ends 122 of support rods 34 are similarly connected via a screw (not shown) extending through a hole 124 in top member 10. Floating component shelf 20 may be adjusted to different positions to accommodate one or more different-sized components by adjusting the size and number of support rods 34 used. As shown in FIG. 14*b*, four support rods 34 are used to increase the space available for components between floating component shelf 20 and top member 10. In addition, it will be appreciated by those of skill in the art with the benefit of this disclosure that holes 60 facilitate easy communication between a television and any components supported by floating component shelf 20.

Preferred embodiments of the present invention have been disclosed. A person of ordinary skill in the art will realize, however, that certain modifications would come within the teachings of this invention. Therefore, the following claims should be studied to determine the true scope and content of the invention.

What is claimed is:

1. An appliance stand comprising:

a base;

a top member spaced from the base;

a first support pillar connected between the base and the top member, the first support pillar comprising a channel for housing wires;

a second support pillar connected between the base and the top member, the second support pillar comprising a plurality of cells arranged in a monolithic structure; and a plurality of protrusions extending from first and second ends of the second support pillar, the plurality of protrusions adapted to engage a corresponding number of recesses in the base and top member.

2. The appliance stand of claim 1 further comprising a side cap adapted to lockingly engage the top member and house the engagement between the plurality of protrusions extending from the first end of the second support pillar and the recesses in the top member.

3. An appliance stand comprising:

a base;

a top member spaced from the base;

a first support pillar connected between the base and the top member, the first support pillar comprising a channel for housing wires; and a shelf attached between the base and the top member, wherein the shelf is adjustable between at least two positions; and wherein the shelf is a glass shelf and is supported between the top member and the base by a bracket mounted to the first support pillar and a shelf support assembly.

4. The appliance stand of claim 3, wherein the shelf support assembly comprises a glass support member and at least one support member rod.

5. An appliance stand comprising:

a base;

a top member spaced from the base; and a first support pillar connected between the base and the top member, the first support pillar comprising a channel for housing wires, wherein said channel is indented into an exterior rear surface of said first support pillar;

wherein the channel is enclosed by a removable access panel; and further comprising a plurality of mini-balls for attaching said access panel to said first support pillar over said channel.

6. An appliance stand comprising:

a base;

a top member spaced from the base;

a first support pillar connected between the base and the top member, the first support pillar comprising a channel for housing wires, wherein said channel is indented into an exterior rear surface of said first support pillar; and a strap attached to said stand with a clip attached to said strap, said clip being configured to clip to a television on the appliance stand.

7. An appliance stand comprising:

a base;

a top member spaced from the base and connected thereto by at least one pillar having a longitudinal axis, the at least one pillar comprising:

an outer skin;

an extruded support structure disposed within the outer skin, the support structure comprising multiple cells arranged along the longitudinal axis for support of longitudinal loads; and a tension bar disposed at least partially within the extruded support structure;

wherein said top member comprises a plurality of guides sized and located to receive feet on an underside of a television set that is placed on said appliance stand.

* * * * *